United States Patent [19]

Assanah et al.

[11] 4,453,732

[45] Jun. 12, 1984

[54] PATIENT TRANSPORT AND CARE VEHICLE

[76] Inventors: Albert A. Assanah, 3407 Wild Cherry Rd., Baltimore, Md. 21207; Fitzroy Assanah; George G. Assanah, both of 3526 Overview Rd., Baltimore, Md. 21215

[21] Appl. No.: 334,233

[22] Filed: Dec. 24, 1981

[51] Int. Cl.[3] ..... A47C 13/00

[52] U.S. Cl. ..... 280/648; 5/68; 5/433; 280/242 WC; 297/118; 297/DIG. 4

[58] Field of Search ..... 280/647, 648, 242 WC, 280/289 WC; 297/433, DIG. 4, 118; 5/68, 73, 80, 81, 432, 433

[56] References Cited

U.S. PATENT DOCUMENTS

| | | | |
|---|---|---|---|
| 3,038,174 | 6/1962 | Brown et al. | 5/68 X |
| 3,138,805 | 6/1964 | Piazza | 297/DIG. 4 |
| 3,185,495 | 5/1965 | Pivacek | 297/DIG. 4 |
| 3,782,749 | 1/1974 | Wiczer | 280/764.1 X |
| 3,889,963 | 6/1975 | Brattgard | 297/DIG. 4 X |
| 3,936,893 | 2/1976 | Anderson et al. | 297/DIG. 4 X |
| 3,953,054 | 4/1976 | Udden et al. | 297/DIG. 4 X |
| 4,079,990 | 3/1978 | McMunn et al. | 297/DIG. 4 X |
| 4,125,269 | 11/1978 | Kiel | 297/DIG. 4 X |
| 4,282,613 | 8/1981 | Violante | 297/118 X |
| 4,285,541 | 8/1981 | Onishi | 5/81 R X |

FOREIGN PATENT DOCUMENTS

| | | | |
|---|---|---|---|
| 1039172 | 9/1978 | Canada | 297/DIG. 4 |
| 1247014 | 9/1971 | United Kingdom | 280/764.1 |

*Primary Examiner*—Joseph F. Peters, Jr.
*Assistant Examiner*—Michael Mar
*Attorney, Agent, or Firm*—Walter G. Finch

[57] ABSTRACT

The invention is an improved vehicle for the transport and care of patients, particularly incontinent patients. The vehicle combines the facility of a wheel chair and a bed-like transport vehicle, such as a mobile stretcher. The vehicle is particularly useful in providing care for incontinent patients who also are difficult to move when providing the care. The basic vehicle resembles a wheel chair which can be conveniently modified, without first moving the patient, into a bed-like facility. In making the modification the vehicle has a collapsible support device as the back portion of the basic wheel chair is lowered to form the bed-like configuration. The vehicle also serves as a temporary rest facility for wheel chair patients who are difficult to move from the wheelchair to a normal bed facility. The vehicle thus facilitates one attendant care of a patient.

6 Claims, 4 Drawing Figures

PATIENT TRANSPORT AND CARE VEHICLE

BACKGROUND AND SUMMARY OF THE INVENTION

The invention relates to patient care equipment and in particular to equipment for the care and transport of incontinent patients. Specifically, it relates to a transport facility that may be used as a wheel chair and which may be converted to a bed-like facility that is similar to a mobile stretcher. The transport facility is particularly useful for incontinent patients, especially those patients who also have a difficult time moving because they lack the use of their limbs. The portable transport and care vehicle facilitates both transport and care by a single attendant.

The portable transport and care vehicle for patients may also be used as a temporary rest facility for the patients using it as a wheel chair, because of the easy conversion from a wheel chair to a bed-like facility, which can be done by a single attendant without the need for removing the patient from the wheel chair.

The patient transport and care vehicle is particularly useful in conjunction with a portable gravity bath facility disclosed in a copending application, Ser. No. 329,447 filed Dec. 10, 1981.

Incontinence care and the problems associated with the management of incontinence among wheelchair dependent and bed-ridden patients at home, in hospitals and in nursing homes, have imposed a tremendous burden upon society, namely the providers and recipients of care and their families. This has occurred primarily becasue of a lack of adequate and appropriate means to deliver care, and from an ever increasing number of the nation's elderly, age 65 years and older, with dementia secondary to primary degenerative dementia.

Since the nineteen sixties, research on the problems of incontinence expanded the use of surgical procedure, indwelling and external catheters, and for a time bowel and bladder training programs in the treatment and management of urinary and fecal incontinence with varying degrees of success. Development of pneumonias and formation of decubiti necessitating, long hospial stay, due to urinary incontinence have been successfully reduced and curtailed to some extent. Success with fecal incontinence, however, with its devastating impact upon patients, relatives, and providers of care has been slower and more difficult to achieve, because of ongoing research in this area and the inability of providers to meet the demand for care by larger and larger numbers of patients with greater dependencies, more severe physical disabilities, and intellectual impairment due to cerebral infarcts.

The high incidence of multi-infarct dementia in individuals over 65 in our society, coupled with an increase in other forms of dementia, such as alcoholic, post-head trauma, post-anoxia, and those both undiagnosed and related to specific neurological diseases, such as Huntington's Chorea and Parkinson's disease, has significantly increased multi-infarct dementias among patient populations in the nation's 25,000 nursing homes, its 7,015 registered and 214 unregistered hospitals.

Research on wheelchairs has progressed very slowly over the last one hundred years, despite increasing dependency of larger numbers of housebound and institutionalized patients who depend upon the use of wheelchairs. Until relatively recently, many of the nation's 250,000 to 500,000 wheelchair dependent patients saw research efforts directed to make manual and powered chairs more easy to operate through radically different wheel designs and attachment of microcomputers. Glaser of Wright State University in Dayton has focused attention on energy expenditure for mobility and efficiency of mobility. Jaffe, Koogle, and La in the Veteran Administration's Department of Rehabilitative Engineering have concentrated on mobility efficiency. Little research has been directed toward comfortability and care delivery, two very important reasons for institutionalization of increasing numbers of patients with incontinence who under different circumstances can be successfully cared for at home.

This invention is developed to obviate the necessity for institutionalization of certain categories of wheelchair dependent incontinent patients and to expand the scope and utilization of wheelchair and bed-type equipment as care delivery items.

In the care of the aged, and particularly the care of incontinent aged and the aged who have suffered a stroke or other injury that deprives them of the use of some or all of their limbs, problems arise for both the patient and the attendant. As a matter of fact, such problems also exist for many patients who are not aged. This invention provides a means for overcoming the problems encountered.

While some improvements have been made in transport equipment for patients, in general all makes of wheel chairs and mobile stretchers have been designed to enhance mobility of the patients and to aid in their transportation. Little or no emphasis has been devoted to improving the equipment to make it more care efficient. This is particularly true regarding transport equipment for bed-ridden patients, especially, the incontinent patients.

Regarding the incontinent patients, the prior art has provided no improvements to permit the cleaning of wheel chair-dependent patients to be carried out with ease and some degree of efficiency. In the prior art it has been necessary to transfer patients from a wheel chair to a bed to clean them. The present invention overcomes these problems.

Incontinent patients, including those who have little or no use of their limbs, experience feelings of a sense of neglect, indignity, and humility because of their conditions of urinary and fecal incontinence. This condition exists in hospitals, nursing homes, and in private homes. The conditions are made worse by the reactions of employee attendants and relatives, perhaps unintentional, to the conditions which exist because of poorly designed transport equipment or the manner in which it must be used. The present invention provides a means for overcoming these conditions.

Although there is a tremendous impact upon the lives of patients, attendants, and relatives by the cited conditions, attempts to deal with the problem of incontinence, primarily fecal incontinence have been feeble and the focus has been misdirected. The result has been that the relationship between patients and their relatives is psychologically depressing, esthetically repulsive, and socially demoralizing.

The problem of total dependence of bed-ridden, or bed to wheel chair, patients associated with incontinence is a severe burden and almost impossible to deal with where a single attendant is involved. Patient neglect and abuse normally follow.

Federal and state regulations in most cases mandate that a minimum of two hours of care be provided to patients in skilled nursing facilities. In many cases the problem of incontinence makes such standards unattainable.

In the prior art, the cleaning of a soiled wheel chair patient still requires the patient to be moved to a bed for the cleaning. When the patient is not only incontinent, but also does not have full use of the limbs, the problem is magnified. This transfer from a wheel chair to a bed is not only difficult, but the soiled condition is made worse by the transfer. The present invention provides a means for minimizing the problems encountered as no transfer from the wheel chair is required and the soiled condition of the patient is not made worse during the use of the patient transport and care vehicle.

In the present invention the patient is relieved of the depressing, self-imposing isolation, and other indignities that incontinent patients feel. The attendants, professional or semi-professional, and relatives, providing nursing care have an improved means of providing the care. The patient transport and care vehicle enables even the non-skilled in the art of caring for the sick, particularly the incontinent, to provide proper care with a minimum of difficulty.

The patient transport and care vehicle is convertible from a wheel chair configuration to a mobile stretcher or bed-like configuration and back again to a wheel chair. The vehicle can be moved easily by a single attendant and can be converted as aforesaid by a single attendant, thus improving the availability of patient care. The conversion can be made without removing the patient from the vehicle when it is in the wheel chair mode or when making the conversion from the bed or stretcher mode to the wheel chair configuration.

Thus, a soiled incontinent patient can be cleaned by a single attendant without placing an added burden on the patient or the attendant. The cleaning is further facilitated when performed in conjunction with the aforementioned portable gravity bath. Such use minimizes the handling of human waste by an attendant.

It is, therefore, an object of this invention to provide a combination transport and care vehicle for patients.

It is another object of this invention to provide a transport and care vehicle to facilitate the handling and cleaning of incontinent patients.

It is also an object of this invention to provide a transport and care vehicle to facilitate the handling and care of patients that do not have full use of their limbs.

It is yet another object of this invention to provide a transport and care vehicle that can be used in a wheel chair configuration.

It is yet still another object of this invention to provide a transport and care vehicle that can be converted to a wheel chair or a mobile stretcher means without removing the patient.

It is also another object of this invention to provide a transport and care vehicle that can be utilized and converted for a plurality of uses by a single attendant.

Another object of this invention is to provide a transport and care vehicle to obviate the necessity for institutionalization of dependent and incontinent patients in nursing homes and hospitals due to incontinence because of lack of the appropriate equipment.

Still another object of this invention is to provide a patient transport and care vehicle which will reduce the cost of hospital and nursing home care due to institutionalization associated with incontinence and/or disability of patients.

Further objects and advantages of the invention will become more apparent in light of the following description of the preferred embodiments.

DESCRIPTION OF THE PREFERRED EMBODIMENTS

Figure 1:
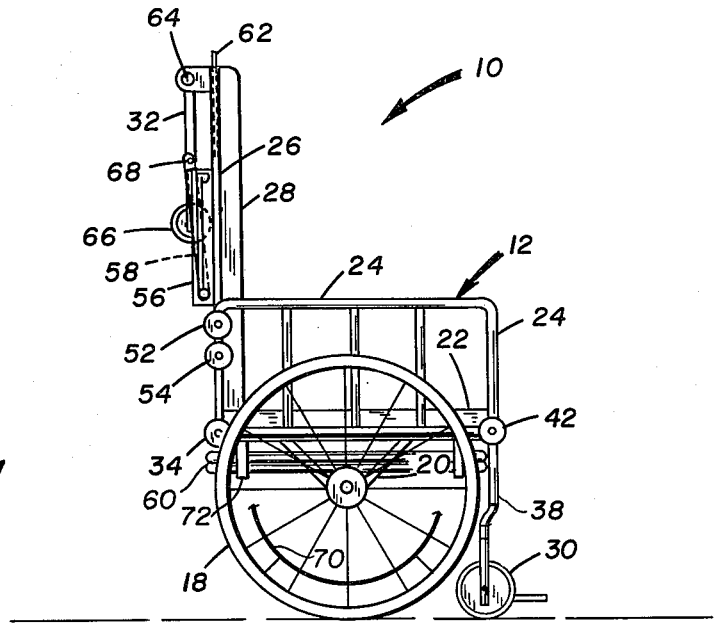
FIG. 1 is a side view of a patient transport and care vehicle in wheel chair configuration.
Figure 2:
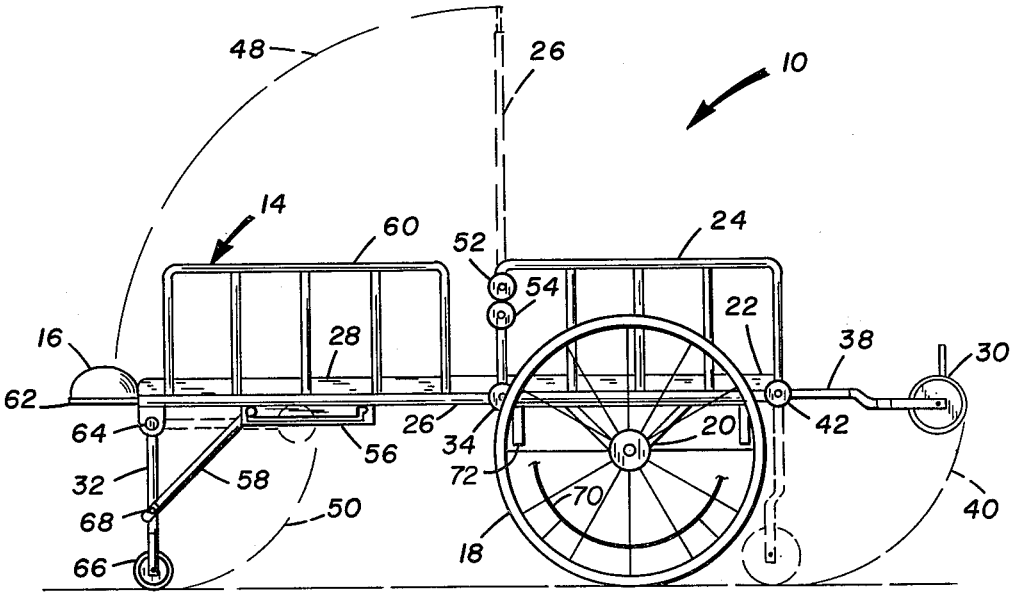
FIG. 2 is a side view of a patient transport and care vehicle in mobile stretcher configuration.
Figure 3:
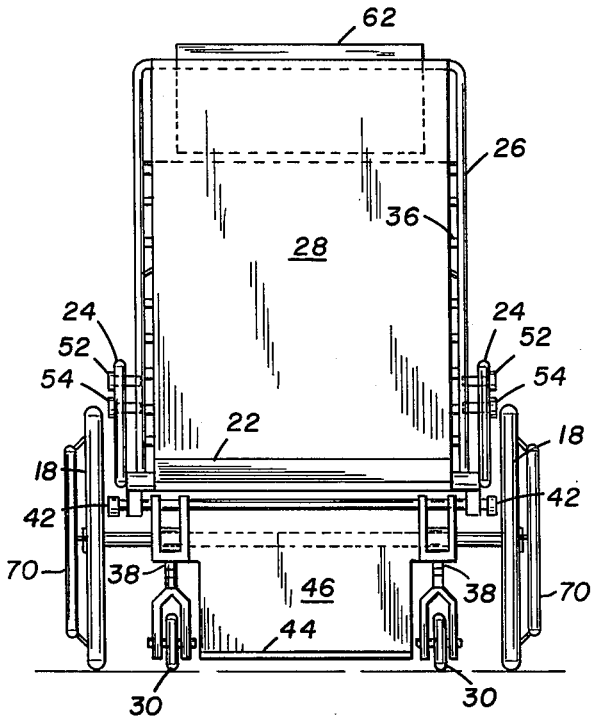
FIG. 3 is a front view of FIG. 1.

Referring now to the drawings and particularly to FIGS. 1 and 2, a patient transport and care vehicle is shown at 10. The patient transport and care vehicle 10 is a convertible piece of equipment that can be converted to two distinctly different configurations. FIG. 1 shows the configuration of a patient transport and care vehicle 10 as a wheel chair 12 FIG. 2 shows configuration of a patient transport and care vehicle 10 as a mobile stretcher 14.

It is to be noted that the mobile stretcher configuration 14 in FIG. 2 can be utilized also as a temporary or interior bed or resting facility for a nap. For example, when wheel chair 12 patients become tired or somewhat exhausted from sitting in a wheel chair 12, it is a simple matter for a single attendant to convert the wheel chair 12 configuration to a mobile stretcher configuration 14. In this latter configuration, the addition of a pillow 16 makes use of the mobile stretcher configuration 14 as a temporary or interim bed for resting or a nap.

The temporary or interim use of the mobile stretcher configuration 14 as a bed is of particular use for patients who are infirm and do not have full use of their limbs. Such patients need help in moving from a wheel chair to a bed or back again to a wheel chair, a single attendant usually is not capable of this difficult task. Thus, the use of a patient transport and care vehicle 10 and its easily convertible configurations accomplishes the task without difficulty and without the need of physically moving the patient.

The patient transport and care vehicle 10 consists primarily of: a pair of wheel chair wheels 18; a wheel chair cushioned sheet 22 (which also serves as a portion of a mattress for the mobile stretcher configuration 14); wheel chair side arms or frames 24; a wheel chair back frame 26 (which also serves as an extension frame when converting to a mobile stretcher configuration 14); a wheel chair back cushion 28 (which also serves as a portion of a mattress for the mobile stretcher configuration 14); a pair of wheel chair casters 30; and a mobile stretcher support member 32. Other accessories, members and devices which tie into the aforementioned primary members are described hereinafter.

The wheel chair wheels 18 are the primary support of the patient transport and care vehicle 10 when it is in a wheel chair configuration 14. The wheel chair support frame 20 is substantially that as known in the art, including axle means for attachment of the wheel chair wheels 18.

The wheel chair support frame 20 also supports the wheel chair cushioned seat 22 which is removably located on the support frame 20 so that cleaning and sanitizing may be accomplished easily.

The wheel chair side arms or frames 24 are rigidly affixed to the wheel chair support frame 20. The wheel chair side arms 24 serve a dual purpose: they are arm rests when the patient transport and care vehicle 10 is in a wheel chair configuration 12; and they are bed sides or frames to prevent a patient from rolling off when the patient transport and care vehicle 10 is in a mobile stretcher configuration 14.

The wheel chair back frame 26 is hinged 34 at the bottom to the wheel chair support frame 20. The hinged 34 connection permits the wheel chair back frame 26 to be lowered for conversion of the wheel chair configuration 12 in FIG. 1 to the mobile stretcher configuration 14, as shown in FIG. 2.

The wheel chair back cushion 28 is removably set in place against the wheel chair back frame 26 so that cleaning and sanitizing may be accomplished easily. To hold the removably placed wheel chair back cushion 28 in place, when in the wheel chair configuration 12, ties (not shown) are affixed to the top portion of the wheel chair back cushion 28 to tie the top edge of the wheel chair back frame 26. When in the mobile stretcher configuration 14, the wheel chair back cushion 28 rests on the spring-like webbing 36.

The wheel chair casters 30, known in the art, are affixed to rotatable leg members 38 to support the front end of the patient transport and care vehicle 10 when in a wheel chair configuration 12. The rotatable leg members 38 are rotatably affixed to the wheel chair support frame 20 at the front end.

The arc of rotation 40, shown in FIG. 2, indicates how the rotatable leg members 38 are raised to become an extension of the bed-level mattress (the wheel chair cushioned seat 22) in order to provide a support for the lower part of the legs and the feet when and after the patient transport and care vehicle 10 is in a mobile stretcher configuration 14. To convert from a mobile stretcher configuration to a wheelchair configuration, the procedure is reversed. A manually releaseable detent means 42 locks each of the rotatable leg members 38 in place at both the lower end and the upper positions shown in FIGS. 1 and 2. It is to be noted and understood that intermediate locking points are within the scope and intent of this invention. Note, however, that the rotatable leg members 38 are not rotated through the arc 40 until the mobile stretcher support member 32 is first lowered by rotating through the arc 50 to interface with the floor.

A foot rest means 44 is affixed to the rotatable leg members 38. The back portion 46 is solid in order to provide a support surface for the feet and lower legs when in the raised position.

It is to be understood that although a single foot rest means 44 is shown between the two rotatable leg members 38, the foot rest portion may be a pair of foldable foot rests as known in the art. A single foot rest means 44 has been shown as being suitable for infirm patients who have little or no use of the legs. Such variations of the foot rest means 44 are within the scope and intent of the invention.

It is also to be noted that although single wheel chair wheels 18 are shown in FIGS. 1, 2, 3, and 4, however, the use of double wheel chair wheels 18 for manual propelling 70 as known in the art, are within the scope and intent of this invention. The manual propelling type wheels 70 have been partially illustrated, as normally infirm patients with little or no use of the limbs have an attendant to move the wheel chair.

In a like manner, mechanically powered wheel chair means affixed to the patient transport and care vehicle 10 is within the scope and intent of the invention.

When converting the wheel chair configuration 12 to the mobile stretcher configuration 14, first the lowering of the back frame 26 passes through an arc 48, and the lowering of the mobile stretcher support member 32 passes through an arc 50, then the rotatable leg members 38 are rotated through arc 40 in order to maintain stability of the transport and care vehicle at all times.

When the wheel chair back frame 26 is raised to convert to the wheel chair configuration 12, the back wheel chair back frame 26 is secured in place by detent locking means 52. Safety lock means 54 is also used to secure the wheel chair back frame 26 in place to doubly secure the connection. The detent locking means 52 and the safety lock means 54 releasably affix the wheel chair back frame 26 to the wheel chair side arms or frames 24.

It is to be noted and understood that the hinged back frame 26 may be equipped with an indexing means (not shown) so that the back frame 26 may be set in a plurality of positions between the vertical and the horizontal to provide a temporary resting position for a patient is within the scope and intent of this invention.

A two index sliding locking means 56 locks braces 58 in place to hold mobile stretcher support member 32 in a rigid vertical position to a wheel chair configuration 12, as in FIG. 2 the mobile stretcher support member 32 folds down when the braces 58 are released from a first index locking position in the two index locking means 56 as in FIG. 2 and reset in a second index locking position in the two index locking means 56 as in FIG. 2. The aforementioned positions are shown in FIG. 2 for the first index locking position of the two index locking means 56 and in FIG. 1 folded down and in the second index locking positions of the two index locking means 56. The braces 58 pivot 68 on support member 22.

Figure 4:
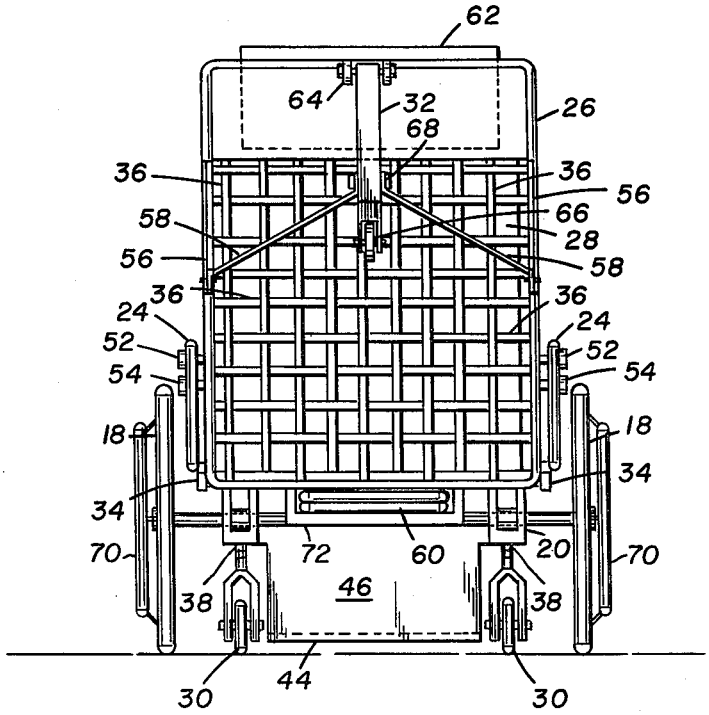
FIG. 4 is a rear view of FIG. 1.

Optional side frame guards 60 are removably affixed to the wheel chair back frame 26 at the head end of the mobile stretcher configuration 14 to add additional safety to prevent a patient from rolling off when being used as a bed or resting facility. The side frame guards 60 are removed and temporarily stored 72 under the wheel chair configuration 12 seat area (as shown in FIGS. 1 and 4) when not in use. It is to be understood that hinged or collapsible side frame guards 60 that fold or slide under or into the wheel chair back frame 26 structure is within the scope and intent of this invention.

A head support extension 62 telescopes into a cavity in the wheel chair back frame 26, as shwon in FIG. 1, and can be extended outwardly, as shown in FIG. 2, when added length is required for the mobile stretcher configuration 14.

The mobile stretcher support member 32 is hinged 64 to the wheel chair back frame 26 and interfaces with the floor through a support wheel 66.

Thus, the patient transport and care vehicle 10 provides for both transportation of patients and the care of patients. Wheel chairs of the prior art are primarily for mobility and are not suited for the delivery of care to the aged or infirm patient, particularly those who have little or no use of the limbs and who are incontinent. The present invention does facilitate the care of such patients. The wheel chairs of the prior art do not provide for the management of the incontinent and other patients as described hereinbefore.

With the population aging, more delivery of proper care is needed. The present invention helps fulfill that need. In particular, with a shortage of patient care personnel the present invention improves the facility of providing care in the home, in nursing homes, and in hospitals, especially as it makes care possible by a single attendant.

It is to be noted that the present invention is particularly useful and efficient in providing care to soiled incontinent patients, especially, when used in conjunction with the aforementioned copending application for a portable gravity bath. When an incontinent patient is soiled it is a simple matter to place a screen around the wheel chair and patient, even in a day room, convert the wheel chair to a mobile stretcher and have the patient lie down, tuck a waterproof blanket and a bath blanket under the patient, and clean the patient using the aforementioned portable gravity bath. A very simple matter in comparison with the difficult prior art of moving such a patient to a bed and then back again.

As can be readily understood from the foregoing description of the invention, the present structure can be configured in different modes to provide the ability to convert a wheel chair to a mobile stretcher.

Although the claims of this invention are indicated in this application, it should be construed that modifications and variations not specified in this invention, to which the invention may be susceptible, are intended to be included in the scope of this invention.

What is claimed is:

1. A patient transport and care vehicle, comprising:

a wheelchair structure, said wheelchair structure having a base frame, a pair of wheels, a foot rest member, a pair of casters, a pair of armrest members, a back frame, and a plurality of releasable detent locking means, said base frame having a first end and a second end and a left side and a right side, said pair of wheels being rotatably affixed to said base frame, said pair of wheels resting on and interfacing with the floor, said pair of wheels being located one on said left side of said base frame and one on said right side of said base frame, said foot rest member being rotatably affixed to said first end of said base frame, said pair of casters being swivally affixed to said foot rest member opposite to said point where said foot rest member is rotatably affixed to said base frame, said pair of casters interfacing with said floor, said pair of arm rest members being located and rigidly affixed to said left and right sides, respectively, of said base frame, said back frame having a first end and a second end and a left side and a right side, said first end of said back frame being hingeably affixed to said second end of said base frame, said back frame defining a pocket-like aperture therewithin, said pocket-like aperture being located in the outboard portion of said second end of said back frame, a first portion of said detent locking means being affixed to each said arm rest member to releasably connect and lock to said left and right sides, respectively, of said back frame, a second portion of said detent locking means being similarly affixed to each said arm rest member to releasably connect and lock to said left and right sides, respectively, of said back frame, said second portion of said detent locking means serving as a safety lock, a third portion of said detent locking means being similarly affixed to each said arm rest member to releasably connect and lock to said rotatably foot rest member;

a mobile stretcher structure, said mobile stretcher structure being a partial conversion of said wheelchair structure, said mobile stretcher structure utilizing said back frame hingeably affixed to said second end of said base frame, when in a horizontal position, and said foot rest member when in a horizontal position; said mobile stretcher structure having a collapsible support member, a brace means, a support wheel; and a pair of side guard members, said collapsible support member being pivotably affixed at said second end of the rearmost side of said back frame, said brace means being pivotably affixed at one end to said collapsible support member and pivotably affixed at the opposite ends to the left and right sides, respectively, of the rearmost side of said back frame, said pivotably affixed ends of said collapsible support member affixed to said left and right sides of said back frame being of a locking index configuration, said support wheel being affixed to the distal end of said collapsible support member and interfacing with said floor, said side guard members being removably affixed to said left and right sides, respectively, of said back frame, said side guard members being suitably stored under said base frame when not in use.

2. A patient transport and care vehicle as recited in claim 1 and additionally, a seat cushion and a back cushion, said seat cushion being removably located on said base frame between said pair of arm rests, said back cushion being removably located on said back frame and centrally situated between said left and right sides of said back frame.

3. A patient transport and care vehicle as recited in claim 2 and additionally, a spring-like webbing affixed to and between said first and second ends of said back frame and between said left and right sides of said back frame, said spring-like webbing providing support for said back cushion.

4. A patient transport and care vehicle as recited in claim 1 and additionally, an extension member, said extension member being slidably inserted into said pocket-like aperture in said second end of said back frame.

5. A patient transport and care vehicle as recited in claim 4, and additionally, a pillow, said pillow being located on said extension member.

6. A patient transport and care vehicle as recited in claim 1 and additionally, a back panel, said back panel being rigidly affixed to said foot rest member to provide a continuous surface when said foot rest member is rotated to its upper position.

* * * * *